US007298244B1

(12) United States Patent
Cress, Sr. et al.

(10) Patent No.: US 7,298,244 B1
(45) Date of Patent: Nov. 20, 2007

(54) NBC MARKER LIGHT

(75) Inventors: James M. Cress, Sr., Rolla, MO (US); Richard D. Wallace, Havre de Grace, MD (US); Corey L. Piepenburg, Nottingham, MD (US); Jerry Huen, Joppa, MD (US); Michael J. Trzeciak, Aberdeen, MD (US); Mark S. Schlein, Abingdon, MD (US); Bruce Archambault, Waynesville, MO (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 220 days.

(21) Appl. No.: 11/217,855

(22) Filed: Aug. 24, 2005

Related U.S. Application Data

(60) Provisional application No. 60/604,381, filed on Aug. 25, 2004.

(51) Int. Cl.
*G08B 23/00* (2006.01)
*G08B 5/00* (2006.01)
*G08B 21/00* (2006.01)

(52) U.S. Cl. ..... 340/321; 340/331; 340/332; 340/815.4; 340/641; 362/394

(58) Field of Classification Search ..... 340/321, 340/331, 332, 815.4, 815.45, 691, 691.3, 340/641; 362/382, 85, 227, 276, 394, 800, 362/802

See application file for complete search history.

(56) References Cited

U.S. PATENT DOCUMENTS

| | | | | |
|---|---|---|---|---|
| 4,730,184 | A * | 3/1988 | Bach | 340/691.5 |
| 6,634,768 | B2 * | 10/2003 | McKenzie et al. | 362/253 |
| 2003/0137415 | A1 * | 7/2003 | Thomson | 340/539.1 |
| 2004/0034689 | A1 * | 2/2004 | Kacalek et al. | 709/206 |
| 2004/0085218 | A1 * | 5/2004 | Pecora | 340/815.4 |
| 2006/0132323 | A1 * | 6/2006 | Grady, Jr. | 340/815.45 |

* cited by examiner

*Primary Examiner*—Toan N. Pham
(74) *Attorney, Agent, or Firm*—Ulysses John Biffoni

(57) ABSTRACT

An NBC marker light is designed to be simplistic, lightweight, and expendable. The case is two pieces, designed for ease of assembly. The assembly includes a circuit card, one or more batteries, light sources, typically IR and visible LEDs, and a custom designed rotary switch. A diffuser is designed to enhance side visibility in all directions.

10 Claims, 13 Drawing Sheets

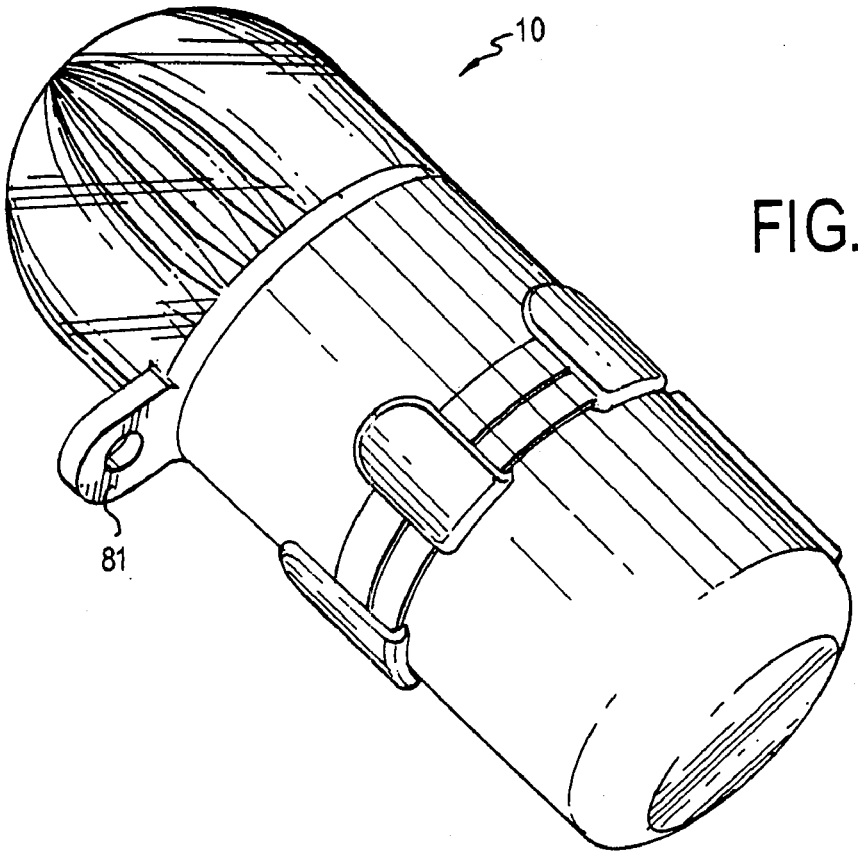
FIG. 8
FIG. 9
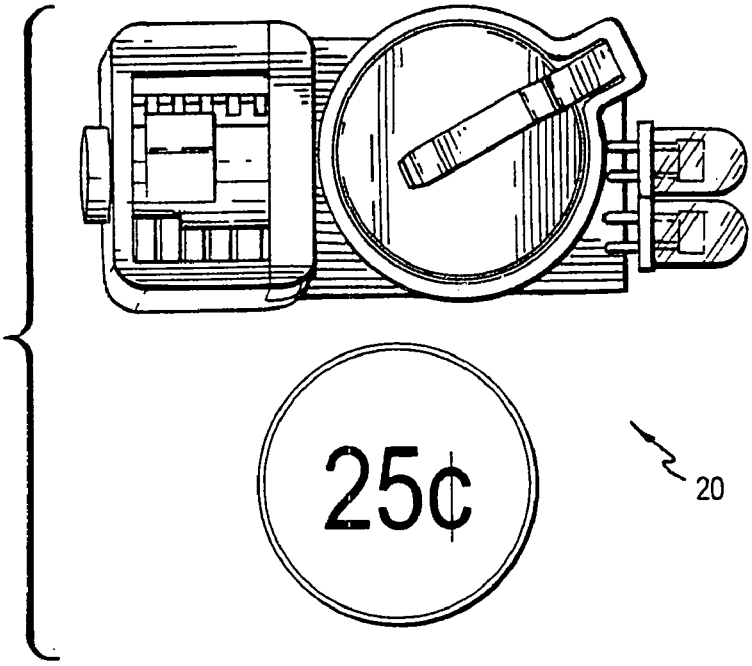

NBC MARKER LIGHT

CROSS REFERENCE TO RELATED APPLICATIONS

This application claims priority from U.S. Provisional Application No. 60/604,381, filed Aug. 25, 2004, herein incorporated by reference in its entirety.

GOVERNMENT INTEREST

The invention herein may be manufactured, used and licensed by or for the U.S. Government.

BACKGROUND OF THE INVENTION

1. Field of the Invention

The invention relates to enhancing the visibility of the current nuclear, biological and chemical weapon (NBC) marking system utilizing a visible and IR flashing light.

2. Background

Throughout the 1980s, the Chemical Corps sought a nuclear, biological, and chemical (NBC) reconnaissance capability that would prevent the possibility of an unwarned encounter with contaminated terrain. With the type classification of the German Transportpanzer 1 Fuchs vehicle as the standard NBC reconnaissance asset, the U.S. Army first became capable of rapidly detecting terrain contaminated with chemical agents. The U.S. variant of this vehicle was designated as the M93A1 Fox Nuclear, Biological, and Chemical Reconnaissance System. The system includes a marker set which consists of a weighted base, a wire mast, and pennants for each class of NBC hazard. Enough components to assemble 175 markers are stored inside the crew compartment of the vehicle. There is a marker chute at the rear of the vehicle which allows assembled markers to be dropped outside without compromising the collective protection system of the vehicle.

Starting with World War I (1914-1918), various methods of marking contaminated areas have been used. All have shared the same goal-preventing an unwarned encounter with a chemically contaminated area. The protocol for annotating the pennant or marker has remained relatively unchanged over the years. When emplaced, the unit, the date-time group, and the hazard are written on the marker, typically using a grease pencil. The identification of these markers is a common task at Skill Level 1 for all soldiers (found in Soldier Training Publication [STP] 21-1-SMCT, Soldier's Manual of Common Tasks Skill Level 1, task number 031-503-1019, React to Chemical or Biological Hazard/Attack). The adequacy of the Fox marker system was an issue during the field-testing of the system before its type classification. With the limited number of markers on board, it was clear that placing them around a typical contaminated area would immediately consume the entire basic load of markers. Soldiers also raised issues concerning the visibility of the markers during periods of darkness and the limited amount of information available at the marker. Following the type classification, field units began to report that the markers were difficult to see and tended to tip over in rough terrain.

In 1997, the U.S. Army Chemical School's Directorate of Combat Developments at Fort McClellan, Ala., drafted a concept for the digital marking of contaminated areas. An evaluation of a concept entitled Smart Marker was proposed. In 1998, the U.S. Army Maneuver Support Battle Lab, Fort Leonard Wood, Mo., managed a limited-scale in-house project designed to demonstrate a long-duration infrared (IR) beacon. A circuit was then assembled based upon an LM3909 integrated circuit and other components purchased at a local electronics store.

The goal of this early experiment was to determine if a small, thumbnail-sized (1 centimeter by 1 centimeter) IR beacon could be used to improve the visibility of a Fox NBC marker for a period of two weeks without a battery change. This experiment was a success: the beacon worked for 87 days (on one AAA battery) without a failure.

The success of the beacon project prompted an investigation into the scope of the capabilities that could be included in a marking system product improvement. The Maneuver Support Center Battle Lab was sponsoring an Army advanced technology demonstration that looked at the development of decision tool software for NBC personnel. The prototype software was installed on a commercially available Windows® CE-based personal data assistant (PDA). The PDA mirrored the capabilities of laptop computers with the same graphics, text files, database utilities, and IR port. When the software contractor delivered the products, they were demonstrated on a PDA that also had a personal computer radio frequency (RF) modem card for Internet access. This allowed the user to obtain online maps via a Web site. Further investigation revealed small Global Positioning System integrated circuits that could be used inside a Smart Marker.

A demonstration to transfer a field survey form and a graphic hazard from a laptop to a PDA was conducted. This caused further interest in the concept. The Smart Marker concept was revised and improved based on the combination of technology demonstrations, market surveys, and collateral readings resulting in development of a U.S. Army Training and Doctrine Command Concept Evaluation Program (CEP) proposal.

The funding needed to conduct the Smart Marker CEP was approved in 1999. The goals of the program were to improve the visibility of the marker and increase the amount of information it makes available. A statement of work was then prepared and a solicitation for bid issued. The University of Missouri-Rolla was selected for the contract, and work began. Government personnel provided the background information on the concept and its goals for the experiment. The one government-specified constraint for the design team was to use commercial off-the-shelf (COTS) technology or components whenever possible.

The project was partitioned into four phases, and transitioning from one phase to the next was contingent upon the results of an in-progress review (IPR). Phase I was a front-end analysis that examined the varying methods of addressing the problems of the existing markers. Phase II was the fabrication of breadboards (alpha prototypes) that demonstrated function and potential and resolved any shortcomings of the existing system within the constraints specified. Phase III involved fabricating and demonstrating functioning prototypes for field demonstration. Phase IV was the demonstration of a working prototype in a limited-objective experiment.

There were three senior design teams assigned to develop three different designs. Each team consisted of one electronics/computer engineering student and two mechanical engineering students. Two of the teams also had one engineering management student each. The three teams arrived at two design approaches. Two of the groups elected to repackage a PDA to take advantage of its built-in functionality. The other team opted for the use of COTS electronic components that were coordinated by a microcontroller. Some time after the work had begun, the teams were reorganized to partition the effort. The three mechanical teams remained, but the electronics development team was consolidated.

The researchers used computer-assisted design and manufacture to create the marker prototypes. Each team had a different solution to the problem of marker stability. One team decided upon a multipod approach using multiple short legs that provided at least three points of contact regardless of its directional orientation. The multipod approach was the closest to the design of the existing marker, but the approach did not demonstrate well during the field trials. An alternative design approach used a counterweighted cylinder with a self-orienting antenna mast. This technique had the advantage of simplicity of design but was difficult to deploy from the Fox and suffered from durability problems. The most successful mechanical design had articulated legs and was self-righting. When cost was considered, it was decided that this approach, however elegant, was not practical.

The electronics module was the most successful element of the design approach. Initially the design teams had two different approaches to the electronic functions. As the teams reviewed the requirements, it became obvious that most of the requirements could be met with a PDA. The battery well, keyboard, and visual display are the biggest parts of the PDA. These parts are unnecessary to the marker function. Two of the teams concluded that a PDA could be repackaged to meet the need. The third team thought that this approach was inefficient and that a fresh breadboard should be developed using miniature COTS electronic components. This approach was selected at a midpoint IPR.

With this decision, the teams were reorganized, and a composite team was created to design an electronics module that was compatible with all three mechanical designs. In response to the reorganization, the scope of work statement was adjusted. This team was given a size constraint for the marker and was instructed to conduct a design-to-fit study. The idea was that the actual device could be larger than the design constraint if standard design practices could configure the electronics to fit the constraint. The engineers took a modular approach, placing the components inside a clear plastic enclosure. The use of a miniature frequency-hopping transceiver ensured that it would be possible to download the marker's data from standoff distances.

A standard graphic interface was designed so that service members who are familiar with WINDOWS products could use the supporting software easily. This approach was an unqualified success, because personnel who were familiar with WINDOWS applications had no difficulty using the prototype software. The terminal used in the field was a standard military contract laptop computer with a Windows NT® operating system. Accordingly, soldiers with experience using these tools had no challenges with the Smart Marker and its supporting software.

The field experimentation was very successful. The Smart Marker concept evaluation demonstrated that by leveraging commercially available technology, it is possible to improve the Fox's (M93A1 Fox Nuclear, Biological, and Chemical Reconnaissance Systems) marking of hazard areas dramatically. Simply adding different flags and a commercially available stick-on beacon makes a significant difference in the ability to detect the marker during periods of limited visibility. Leveraging available technology allows the standoff download of detailed hazard information via RF modem or digital download via the IR or the hardwire communication port. In the case of the RF mode, detailed hazard data was visible in the cab of a truck 300 meters before the marker was encountered. While this project focused upon the Fox, its findings could be useful for a number of different applications, such as minefield, hazard, and traffic-control marking.

The current method of tactically marking NBC contaminated areas utilizes a weighted self-righting base with an 18 inch staff that has a flag attached. This marker is deployed through a sleeve in the hull of the NBC recon vehicle, which limits the overall length and diameter. The visibility of this item is limited to day time only and depending on the viewing angle can be nearly invisible from 50 feet away. Night time visibility is currently marginal reflectivity at best. This allows soldiers to accidentally enter contaminated areas. A need exists for a device to warn soldiers of a contaminated area up to 500 meters away while still being deployable through the NBC recon vehicle sleeve.

SUMMARY OF THE INVENTION

The invention relates to an NBC warning light including a plurality of warning indicators, comprising an infrared light source and a visible light source; a electronics assembly operatively connected to selectively operate said warning indicators; a switch, said switch having a plurality of operable positions, wherein each of said operable positions commands said electronics assembly; and a power source.

The NBC marker light is designed to be simplistic, lightweight, and expendable. The case is two pieces, designed for ease of assembly. The assembly typically includes a circuit card, one or two or more coin batteries, IR and visible LEDs and a custom designed rotary switch. A diffuser is designed to enhance side visibility in all directions.

BRIEF DESCRIPTION OF THE DRAWINGS

FIGS. 8-12 show photographs of the embodiment of FIG. 1 and its electrical components.

DETAILED DESCRIPTION OF THE INVENTION

Figure 2:
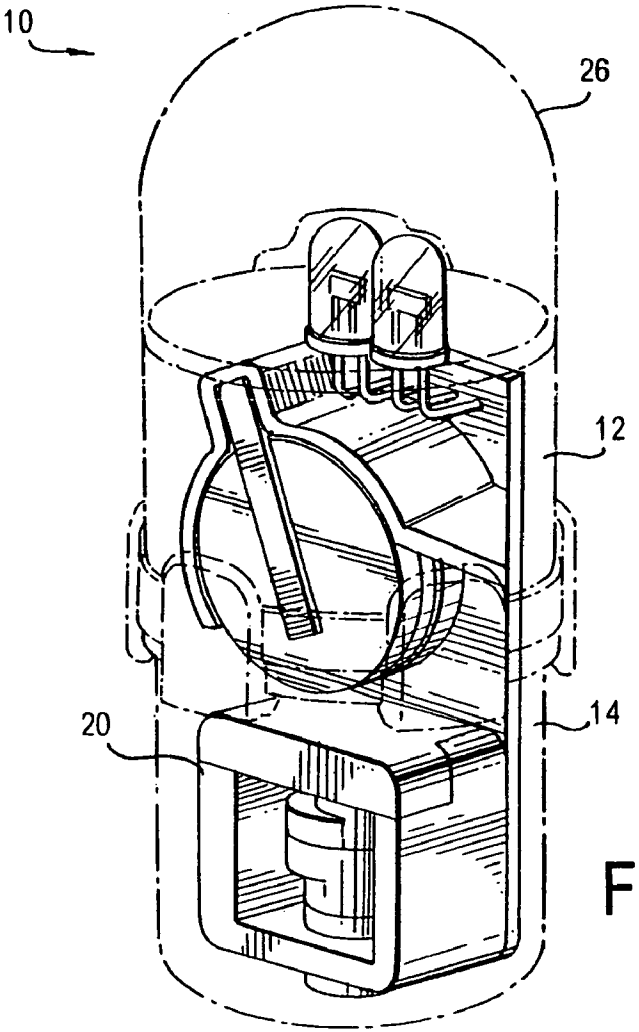
FIG. 2 is a cut-away view of a second embodiment of the invention.
Figure 1:
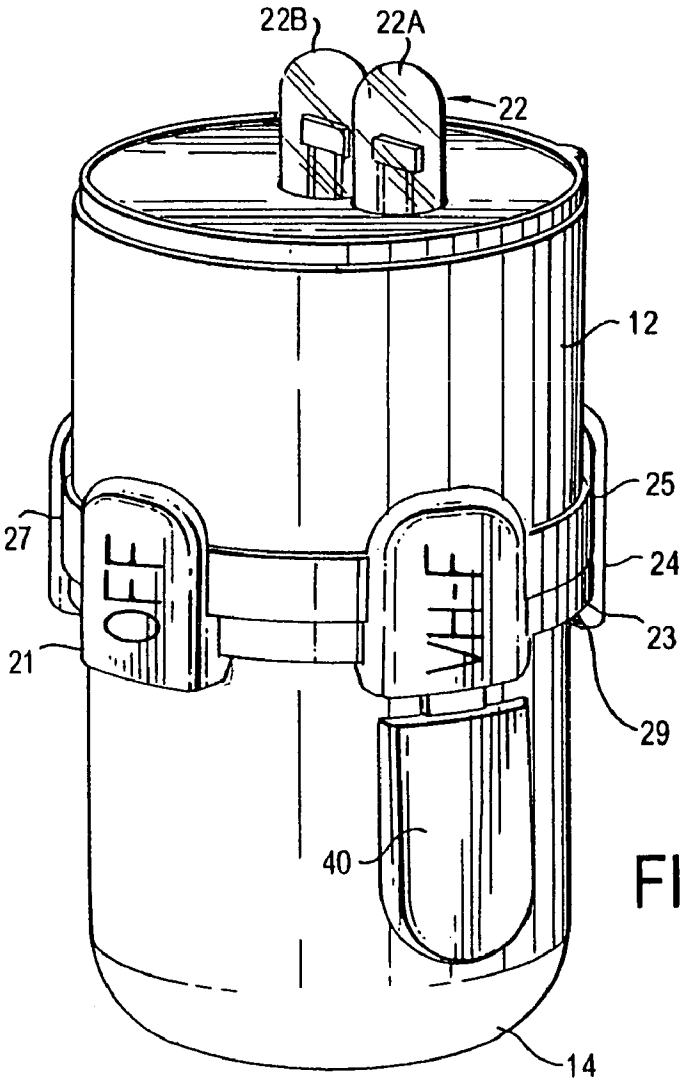
FIG. 1 is a view of a first embodiment of the invention.
Figure 4:
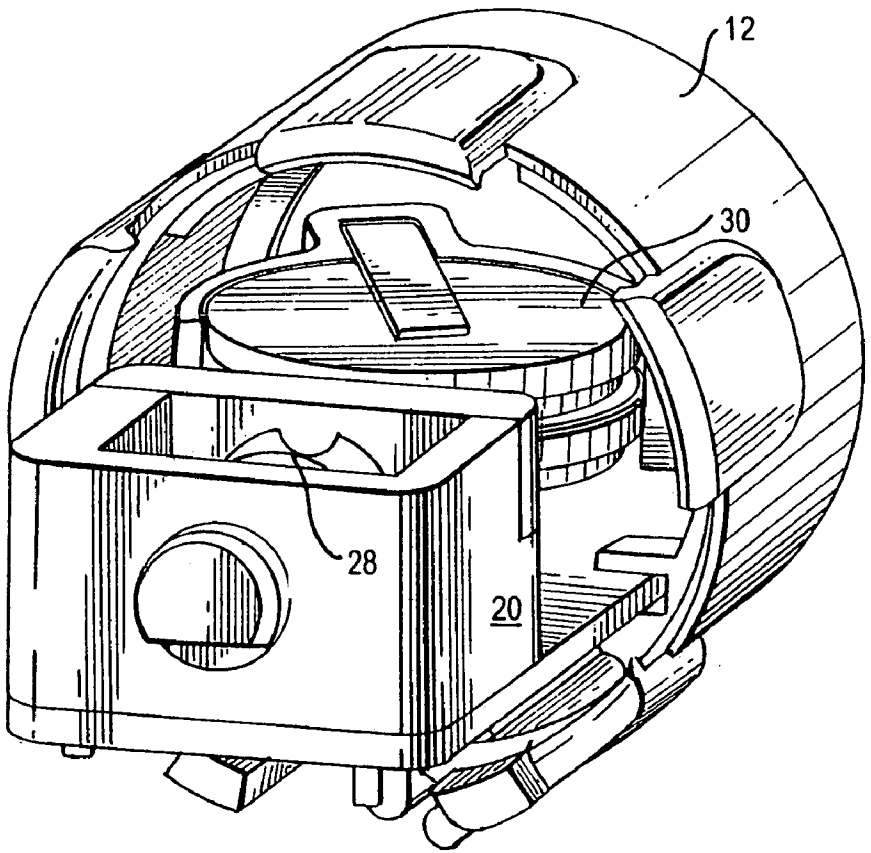
FIG. 4 is a side view of the assembly shown in FIG. 3.

FIG. 1 shows the nuclear, biological and chemical weapon (NBC) marker light 10 of the invention. The light 10 typically includes an upper case 12 and a lower case 14, housing a battery 30 and electronics assembly 20 (FIG. 3) therein. Typically, one or two or more coin batteries 30 are employed. Preferably, a pair of warning indicators 22 is disposed at an upper end of the battery 30 and electronics assembly 20, and extending through an aperture in the upper case 12.

The warning indicators 22 preferably include an infrared (IR) light source 22A and a visible light source 22B, which can be independently operated to actuate multi-position switch 28 depending upon the selected mode. The mode can be selected by rotating a selection collar 24 to align with indicia provided on either the upper case 12 or the lower case 14. Additionally, selection collar 14 can be integral with either of the upper case 12 or the lower case 14, such that rotation of the upper case 12 with respect to lower case 14 (or vise versa) rotates selection collar 24.

Typically, marker light 10 has a generally cylindrical shape, having an outer diameter of between 1 and 5 inches, preferably between about 1 and 3 inches, for example approximately 1.125 inches. The length of the marker light 10 is typically between 1 and 5 inches, preferably between 2 and 4 inches, for example approximately 3 inches long.

Preferably, both the upper case 12 and the bottom case 14 are injection molded, and formed from black ABS plastic. However, any construction is permitted. For example, other plastics, such as polyolefins, natural materials, such as wood or metals, or composites may be utilized. However, the particular construction must be capable of withstanding the environmental conditions of the expected use.

Figure 3:
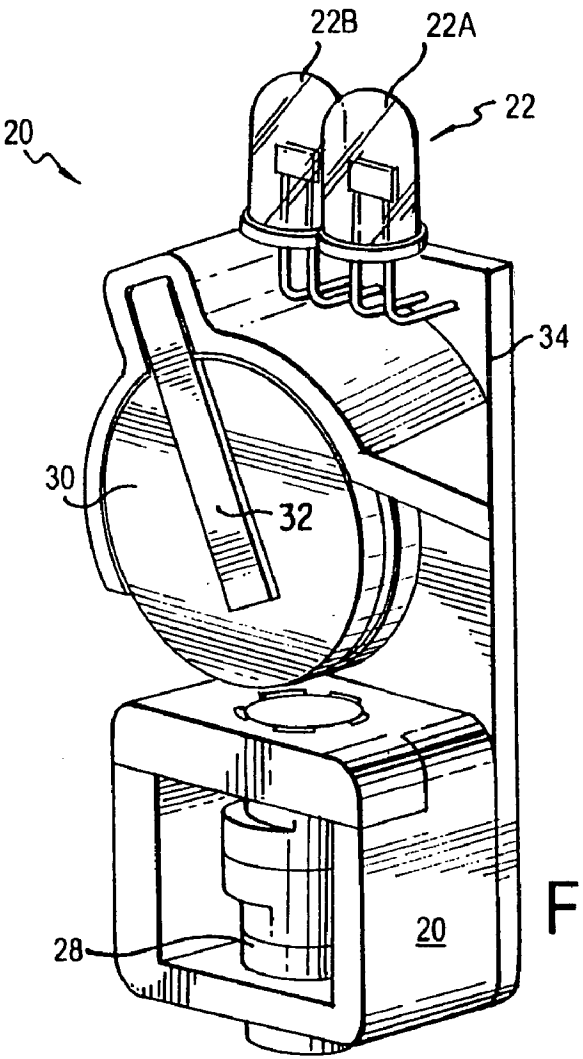
FIG. 3 shows a battery and electronics assembly to be used in the invention.

In a first embodiment, the upper case 12 and the lower case 14 snap together permanently. As shown in FIG. 1, lower ends of tabs 21, 23, 25, 27 snap fit over a rim of the lower case 14. The lower case 14 of the case rotates in the upper case 12 to actuate a switch 28 contained as part of the battery and electronics assembly 20 (FIG. 3). Positions are identified by a raised bar 40 on the bottom of the lower case 14 and engraved tabs, e.g. tabs 21, 23, 25, 27 on the top part of the light 10. Typical markings include: WH-S, WH-F, a solid raised bar, IR-F, IR-S, indicating white-steady, white-flash, off, infrared-flash and infrared-flash, respectively. In one embodiment, the indicia are provided on selection collar 24 as shown in FIG. 1. The function of light 10, when each of the various indicia is selected will be hereinafter described.

Figure 5:
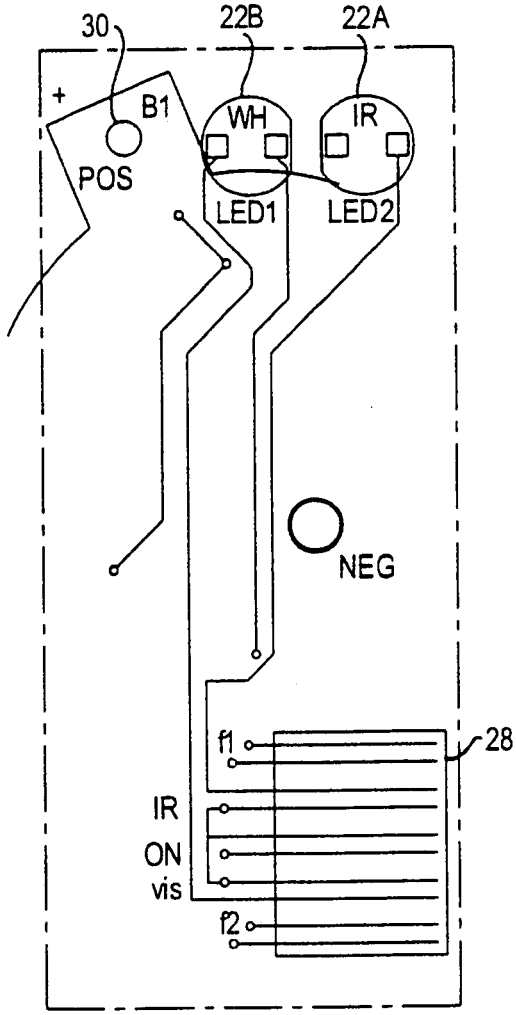
FIGS. 5-7 are circuit diagrams showing typical circuitry which can be used with the invention.
Figure 6:
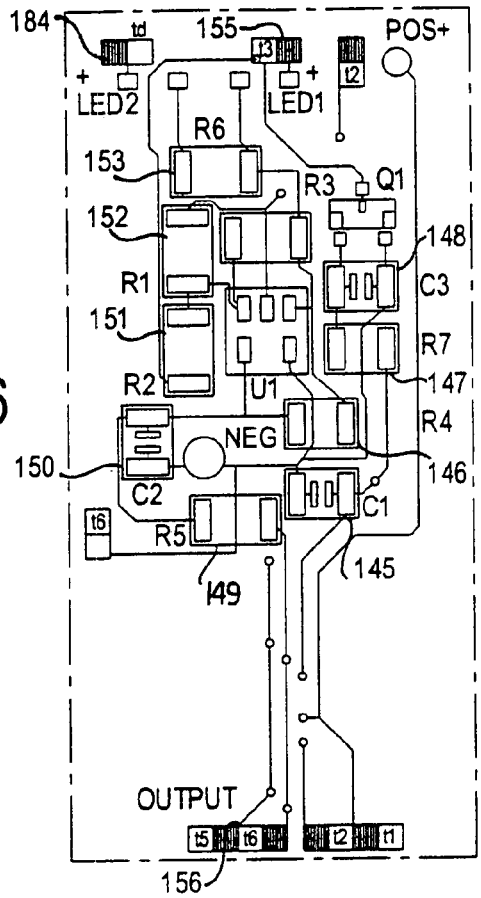
Figure 7:
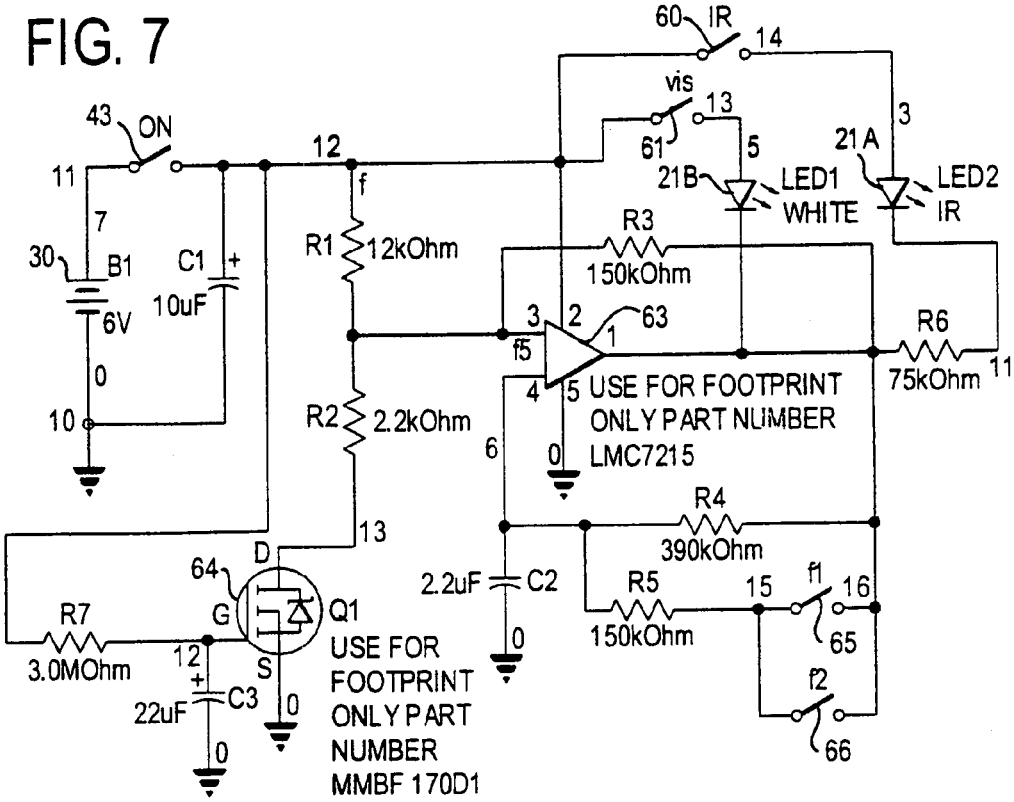
Figure 10:
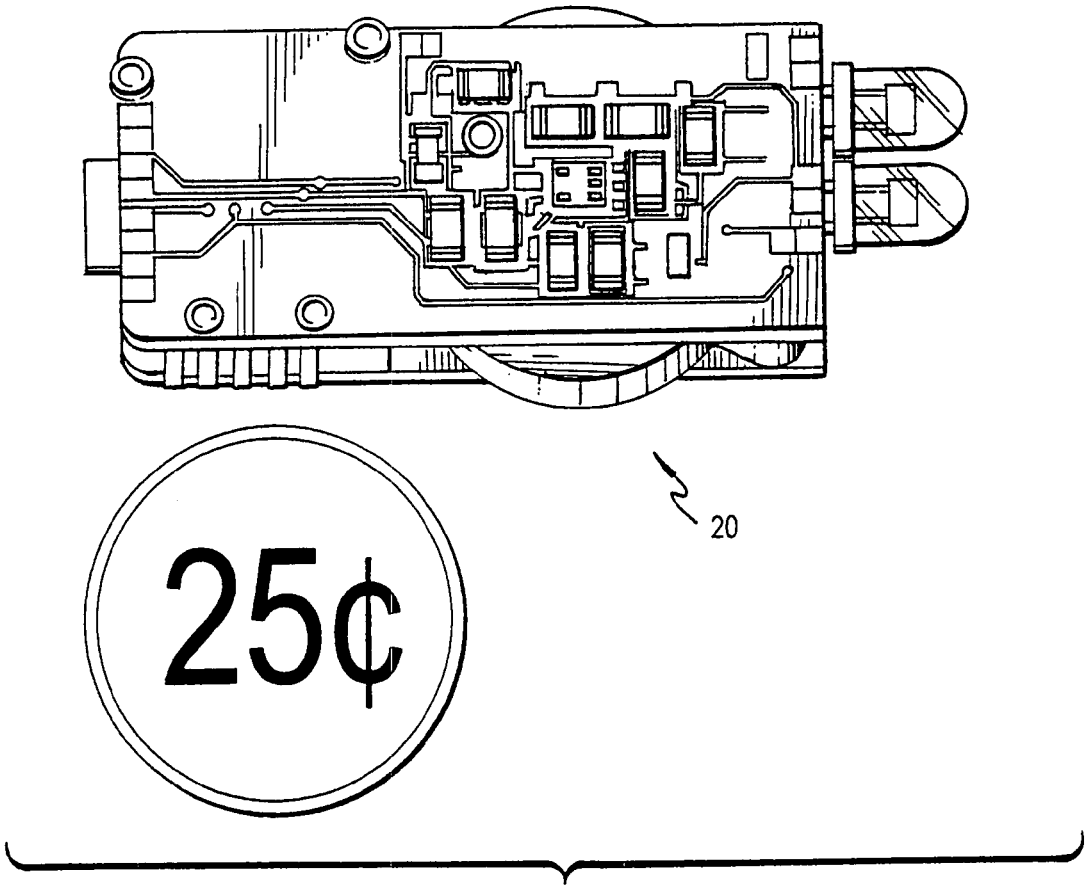
Figure 11:
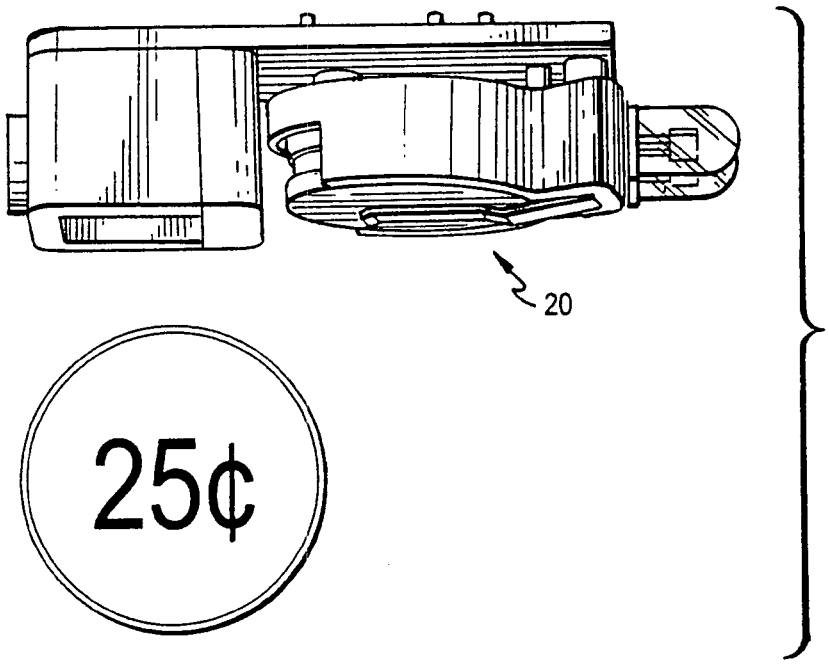

The switch 28 is a typically rotary cam actuating five nickel plated contacts that mate with adjoining surfaces on the circuit board. The switch can be heat staked on to the circuit board which is designed to control flash length, intensity and frequency of the selected warning indicators. Typical configurations for the circuitry are shown in FIGS. 5-7.

The battery and electronics assembly 20 also includes a power source, such as a pair of batteries 30. In one embodiment, the batteries are CR2032 type batteries, held in place by a battery clip 32, and typically have a life of a minimum of 72 hours at −20° C.

While the preferred embodiment of light 10 is not designed to be re-used upon expiration of the power source, it is within the scope of the invention to produce light 10 with a replaceable power source. Typically, this is accomplished by making upper case 12 removable from lower case 14, and batteries 30 removable. Additionally, the power source may provided with a rechargeable apparatus, such as a small solar cell or a weight, which when moved generates an electrical charge sufficient to recharge the power source.

Figure 4A:
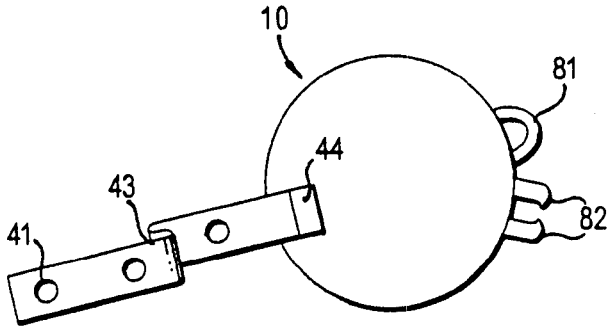
FIG. 4A shows a bottom view of the embodiment of FIG. 1 with a loop attached to its diffuser and a five-fingered clip added to its body.
Figure 4B:
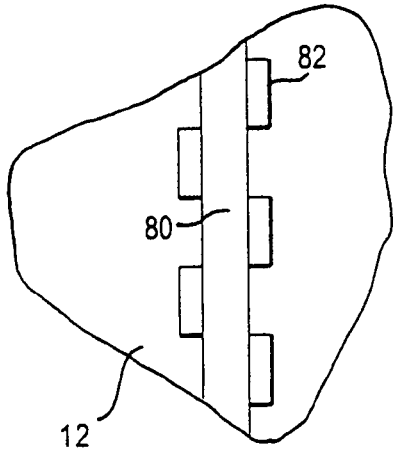
FIG. 4B shows a portion of the embodiment of FIG. 4A attached to a pole by the five fingered clip.
Figure 12:
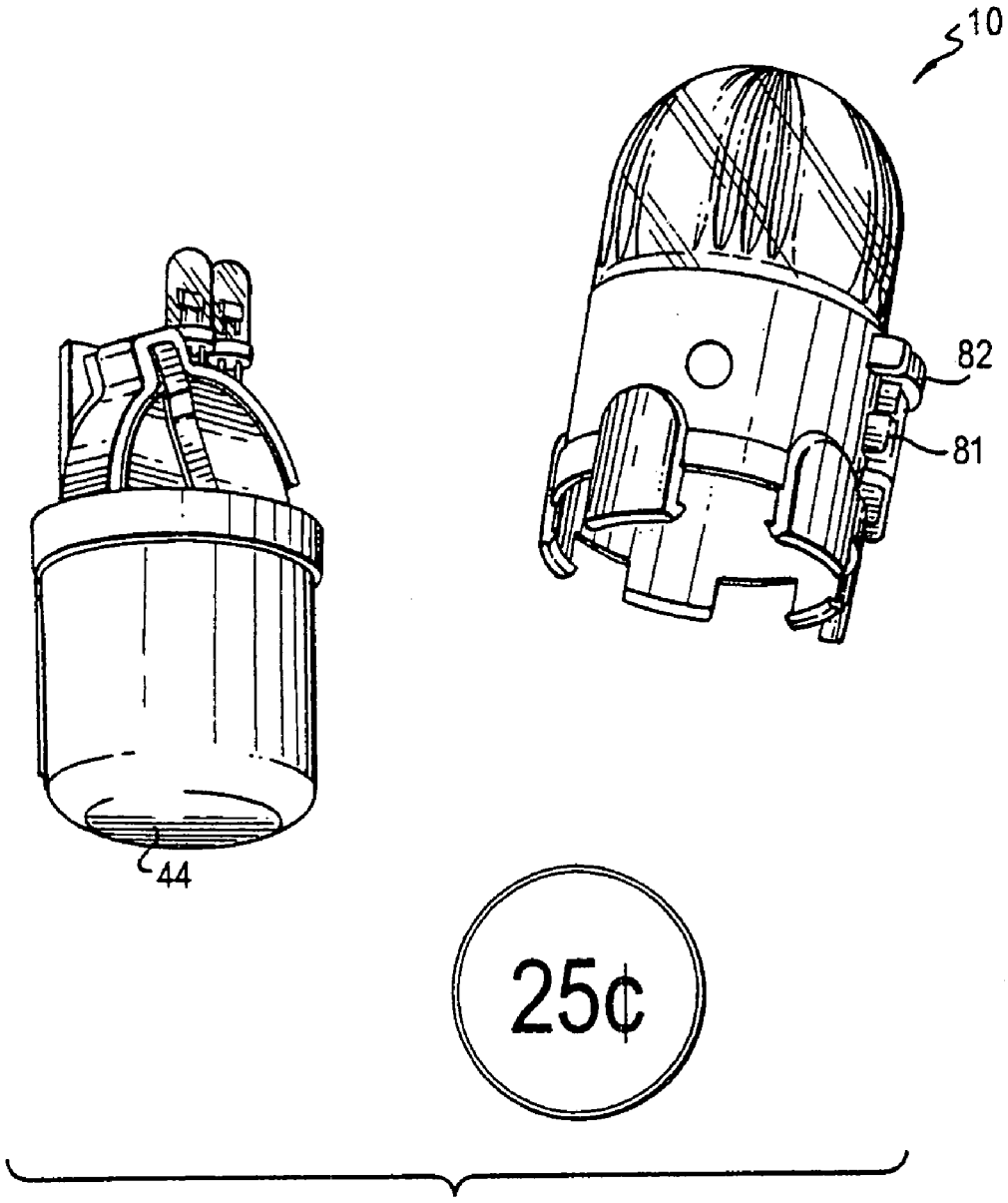
Figure 13:
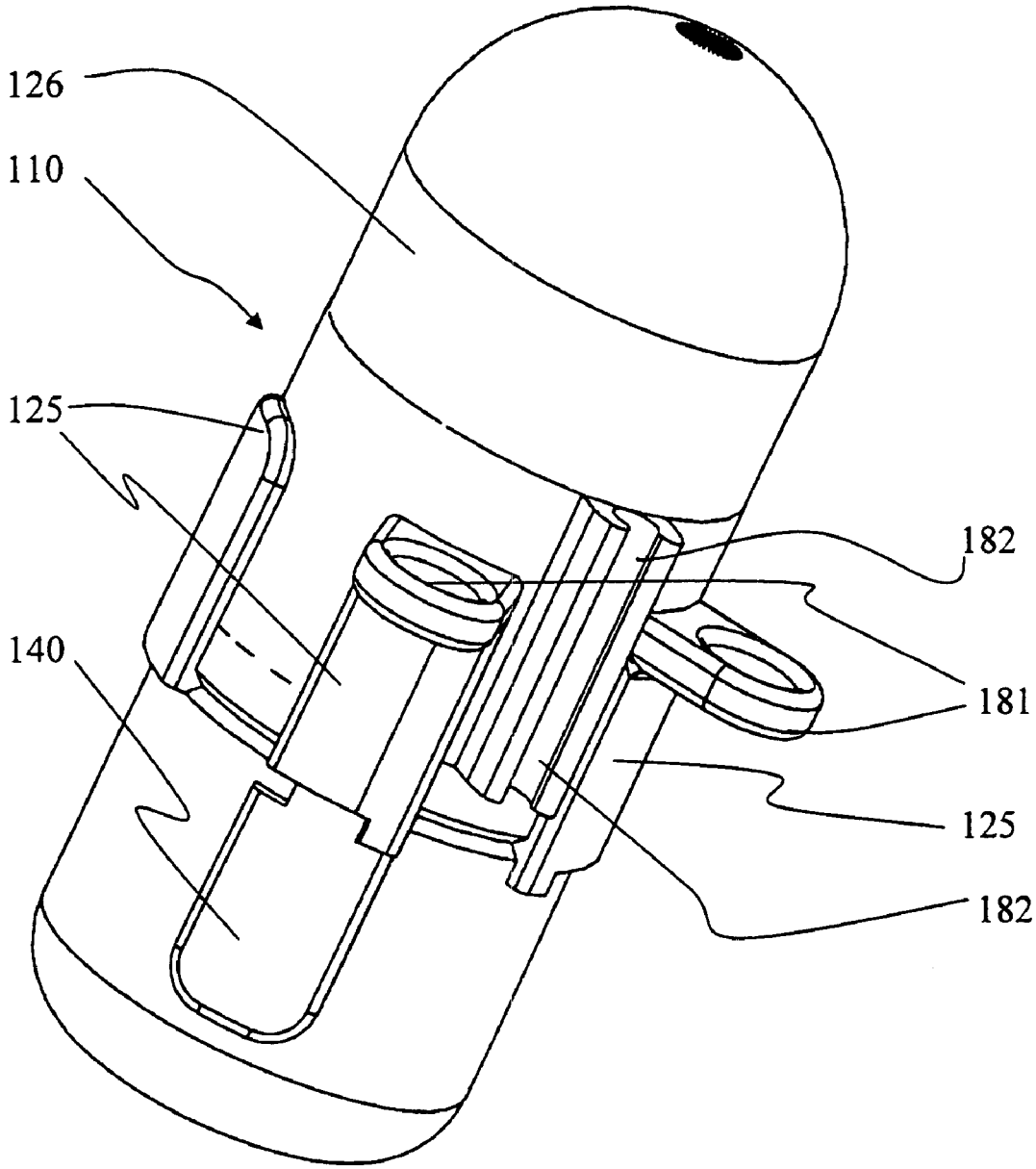
FIGS. 13-18 show a second embodiment of the marker light 110 of the present invention.
Figure 14:
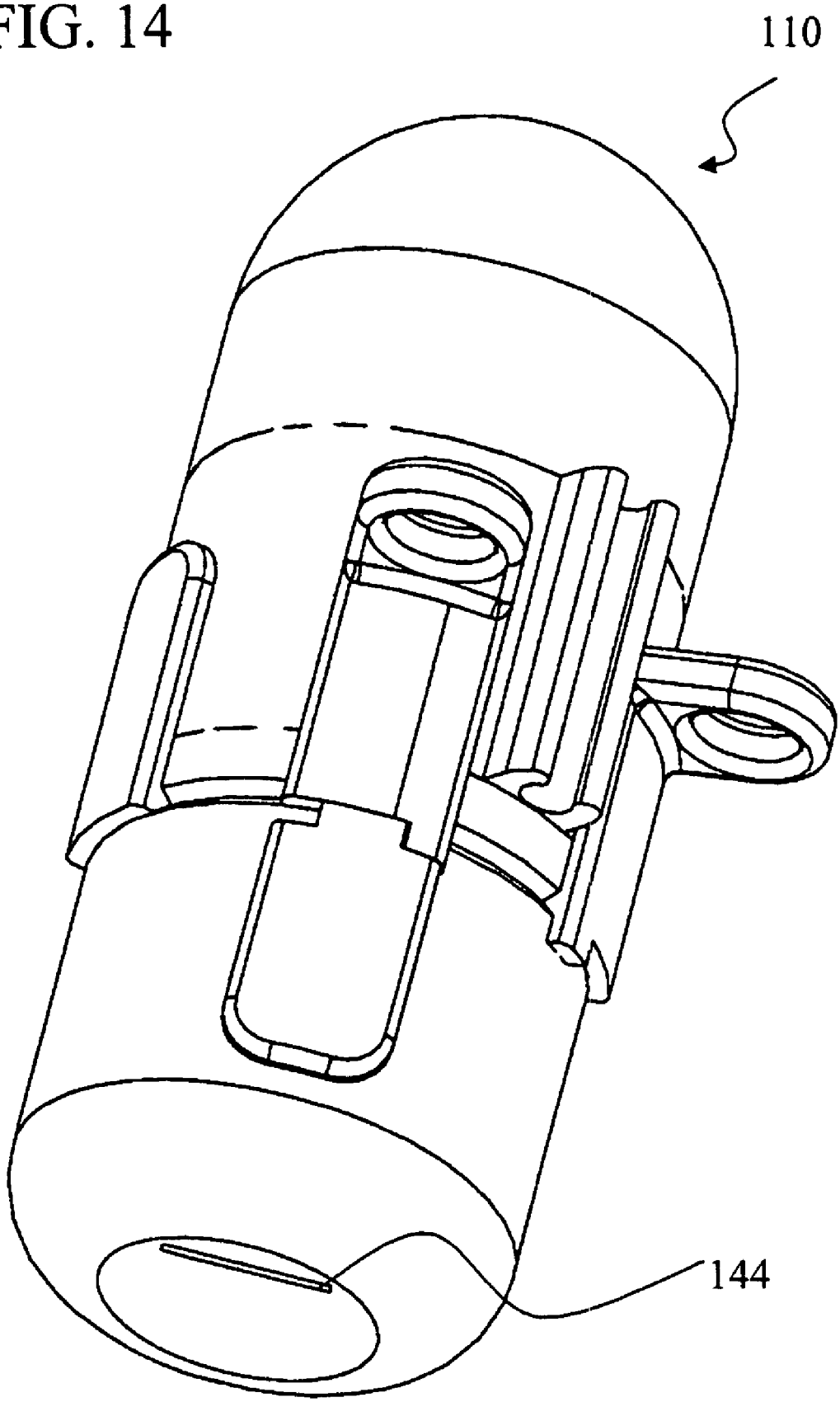
Figure 15:
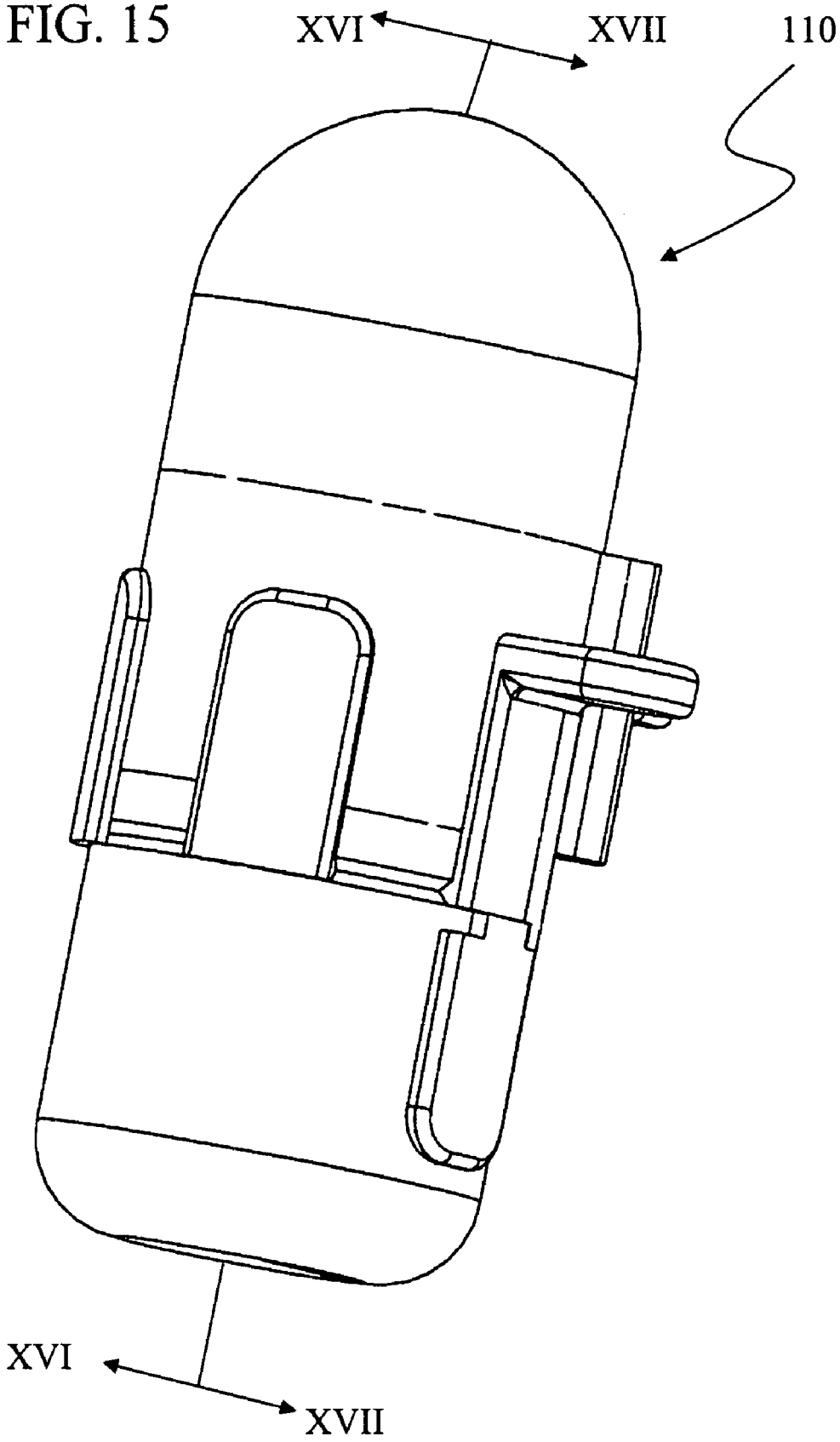
Figure 16:
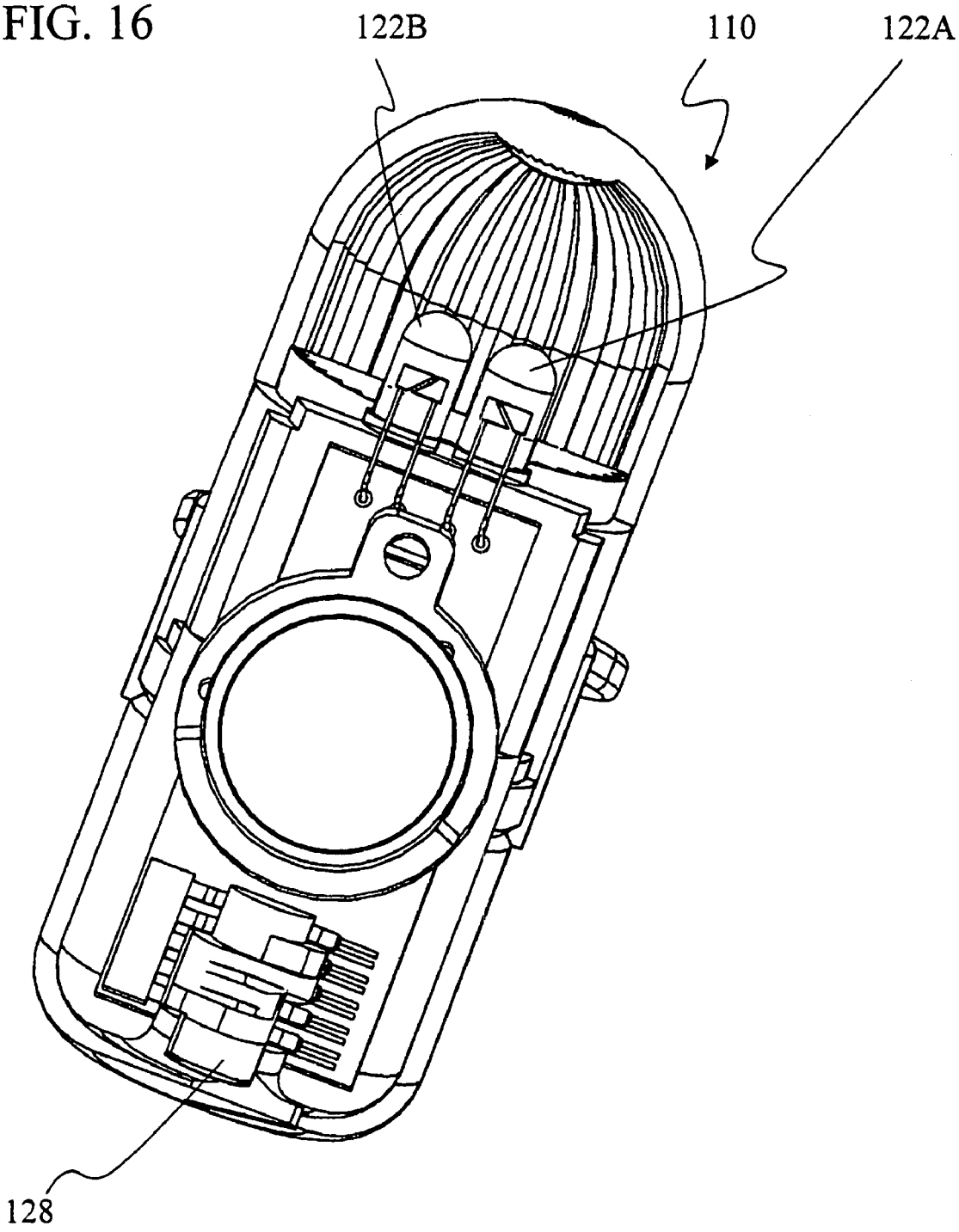

In a preferred embodiment, the circuit board slides into a locating slot in the upper case 12 and is held in place by the lower housing 14. A clear polycarbonate diffuser 26 at the top covers both IR LED 22A and Visible light LED 22B. One side of the diffuser 26 is typically provided with a circular loop 81 of about ¼ inch diameter. FIGS. 4A and 12 illustrate the loop 81 attached to its diffuser 26 and a five-fingered clip 82 attached to or extending from the upper case 12. This loop 81 is designed to secure the bottom of the NBC flag utilizing a standard zip tie. This loop 81 and zip tie can be used to secure the light to any number of other objects requiring marking. The 5 finger clip 42 is designed to securely attach the light to the current NBC Marker staff (pole) 80. FIG. 4B shows a portion of the embodiment of FIG. 1 attached to the pole 80 by the five fingered clip 42.

The lower portion of the case also typically has a slot 44 for a battery disconnect pull-tab 43 for shipping. FIG. 4A shows a bottom view of the embodiment of FIG. 1 with the pull tab 43 and slot 44. The disconnect tab has one or more punched holes 41 to connect a trip wire (not shown) to use as a covert IR warning device.

The invention includes selectable Infrared (IR) and Visible light sources 22A, 22B to upgrade and enhance the current NBC marker system. This is a unique design that fits seamlessly into the current NBC marking system without modification. This device provides a means to increase the day and nighttime visibility of the current NBC marker system by several hundred meters while utilizing the marker's current staff and base. The light is designed to be small lightweight, and disposable. Its intended performance is to be visible at 500 meters at night and have a minimum longevity of 72 hours at minus twenty degrees Celsius. It has two flash frequencies; one hertz and one and one half hertz for either IR or Visible light. It is designed with a clip on the case that mates with the current NBC marker staff and a tie loop to secure the bottom of the marker flag in the correct position for added reflectivity. Its rotary switching mechanism has five modes: fast and slow frequency rates for IR or Visible light and an off position. The rotary switch allows for easy mode selection while wearing MOPP4 (Mission-Oriented Protective Posture level 4) gear. (For example, at MOPP4 soldiers should first mask, then don protective gloves. Overgarments should be closed, and then overboots should be put on).

The rotary switch also provides positive position lock for feedback while wearing gloves. The overall weight is typically less than 10 oz. and will not affect the self-righting capability of the NBC marker. It also features a 10 second turn—on delay to allow placement and movement before marking the area.

The operation of light 10 preferably proceeds as follows. As packaged and shipped, light is packaged with the switch 28 in the OFF position wherein the raised bar on the bottom of the lower part 14 of the case would be aligned with the "OFF" marking 21. When a Visible Light Mode ("VLM") is desired, while holding the upper case 12, with the diffuser 26 pointing away, the lower case 14 clockwise is rotated to align the raised bar on the bottom of the lower part of the lower case 14 with the correct marking. The first position, associated with the marking "WH-F" 23 (FIG. 1) is visible light, fast speed. The second position, associated with the marking "WH-S" 25 is the visible light slow speed.

To activate the infrared light mode ("ILM"), the lower case 14 is rotated counter clockwise with respect to the upper case 12. The first position, associated with the marking "IR-F" (not shown) is infrared light, fast speed. The second position, associated with the marking "1F-S" 27 is the infrared light slow speed. This feature allows the light to designate clear (safe) paths through the contaminated area. This is typically done by placing a series of markers flashing at slow speed in a first line and a second set of markers flashing at high speed in a second line alongside the first line to define the path between the two lines.

Although the markings are described as coinciding with only five different operation modes, i.e., off, VLM fast and slow, and ILM fast and slow, it is within the scope of the invention to modify the operation modes. For example, in one embodiment, operation modes can include additional VLM and/or ILM speeds to indicate various conditions, such type of NBC, or decontamination status of the area. In such a case, the number of markings would be increased.

The warning indicators 22 may also include other warning signals, such as various colors, or signals invisible to the naked eye. Such signals can include ultra-violet or radio signals, which require specialized goggles or other equipment to process or analyze the signal.

To mount the light 10 for use in the field, typically, the light 10 is clipped to the NBC marker staff with a lens loop just below the bottom of the flag, and light 10 is secured at the bottom of the flag to the loop using the tie provided with the flag. The case of the light 10 also typically has a slot for a battery disconnect pull-tab for shipping. The pull-tab is removed just prior to deploying the marker.

Although light 10 is not designed to be decontaminated, in some embodiments, it may be constructed to withstand a decontamination procedure.

Furthermore, although light 10 is designed to be manually actuated, it is within the scope of the invention to equip light 10 with an automatic detection and analysis apparatus 50 (not shown) which can actuate switch 28 upon detection of any NBC contaminant with manual activation. In these embodiments, the apparatus 50 can be designed as described by U.S. Published Application No. 2004/0257227 and U.S. Pat. Nos. 5,278,539 and 5,576,952, each of which is incorporated by reference it its entirety.

The light 10 may also be designed to give an advance warning to personnel outside the visible range of the light 10 by transmitting a signal to such personnel, which signal can include various data, such as type of contaminant and location, and may be activated upon a command from apparatus 50 or simply when light 10 is manually activated.

FIGS. 5-7 are circuit diagrams showing typical circuitry which can be used with the present invention.

FIG. 5 shows circuitry associated with the multi-position switch 28 employed in the present invention. This includes the battery 30, the visible LED 22B, the IR LED 22A and the multi-position switch 28.

FIG. 6 also shows details of the card containing the circuitry associated with the multi-position switch 28 employed in the present invention. This shows output 154 to the visible LED 22B, output 155 to the IR LED 22A, capacitor 148, resistor 147, resistor 146, capacitor 145. This also shows output 156 to switch 28 (not shown in this figure), resistor 149, capacitor 150, resistor 151, resistor 152, and resistor 153. This circuitry controls flash intervals.

FIG. 7 shows a schematic of the circuitry for controlling flash intervals. This contains the battery 30, the pull tab 43, a switch 60 for the IR LED 22A, a switch 61 for the visible light LED 22B, CMOS device 63, switches 65, 66 for switching flash rate control, and field effect transistor (N channel MOSFET) 64. FIG. 7 also shows R1-R7 resistors and C1-C3 capacitors.

FIGS. 8-12 show photographs of the embodiment 10 of the present invention and its electrical components 20.

Figure 17:
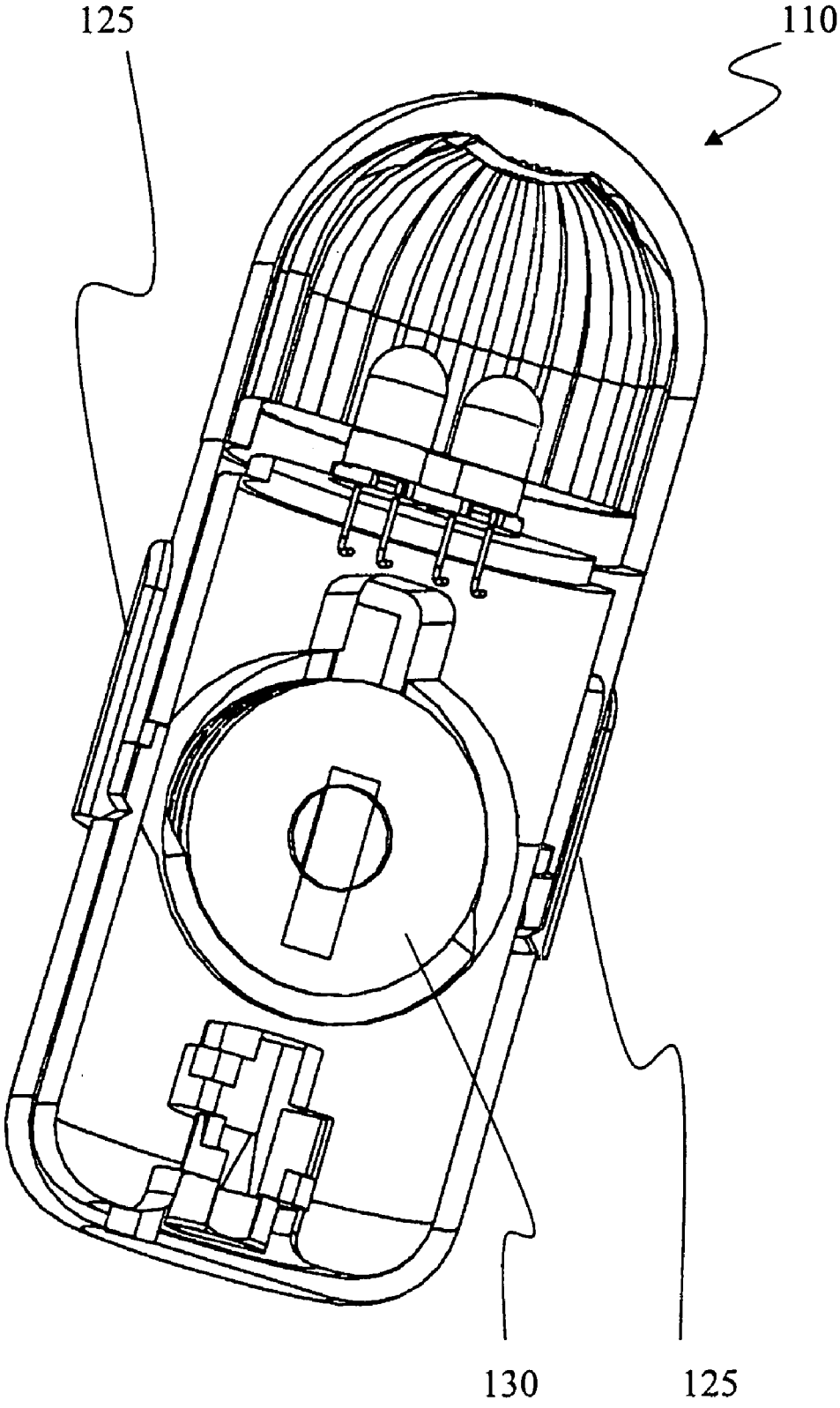
Figure 18:
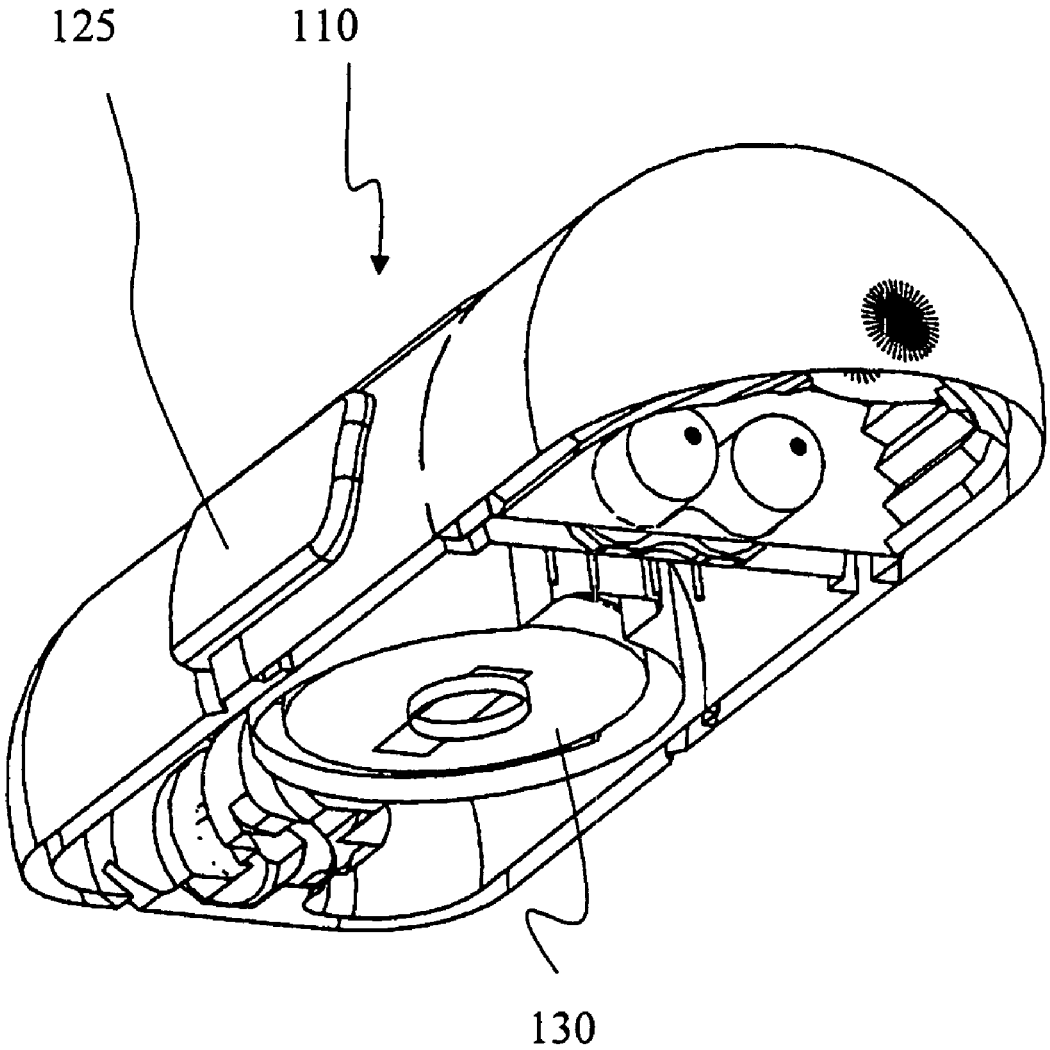

FIGS. 13-18 show a second embodiment of the marker light 110 of the present invention. The marker light 110 has a diffuser 126, tabs 125, loops 181 and a two fingered clip 182. Its lower body has a slot 144 (FIG. 14) for holding a pull tab (not shown) similar in operation to the slot 44 and pull tab 43 of the first embodiment 10. The second embodiment 110 operates substantially the same as the first embodiment 10. and is provided with an IR LED or bulb 122A and a visible light LED or bulb 122B controlled by a multiple position switch 128 (FIG. 16) and powered by one or more batteries 130 (FIG. 17).

It should be noted that while IR LEDs and visible light LEDs are shown in the above-described embodiments, other measurable signal generators may be substituted. For example, two different color visible lights could be employed and/or bulbs rather than LEDs could be employed.

In view of the above it should be apparent that embodiments other than those expressly described above come within the spirit and scope of the present invention. Thus, the present invention is not limited by the above-provided description but rather is defined by the claims appended hereto.

We claim:

1. An NBC warning light, comprising:

a plurality of warning indicators, comprising at least two light sources;

an electronics assembly operatively connected to selectively operate said warning indicators;

a switch, said switch having a plurality of operable positions, wherein each of said operable positions commands said electronics assembly;

a power source; and wherein said warning indicators, said electronics assembly, said power source and at least part of said switch are contained within a case, said case having an upper section and a lower section, wherein said upper section is rotatable with respect to said lower section, and wherein said operable positions of said switch correspond to positions of said upper section with respect to said lower section, such that rotating said upper section with respect to said lower section actuates said switch into its operable positions respectively.

2. The warning light of claim 1, wherein said at least two light sources comprise an infrared light source and a visible light source.

3. The warning light of claim 1, wherein said operable positions comprise:

a first position, wherein said first position commands said electronics assembly to operate each of said warning indicators simultaneously;

a second position, wherein said second position commands said electronics assembly to operate only one of said warning indicators; and a third position, wherein said third position commands said electronics assembly to operate none of said warning indicators.

4. The warning light of claim 3, wherein said operable positions further comprise additional positions, wherein said additional positions command said electronics assembly to operate at least one warning indicator intermittently.

5. The warning light of claim 4, wherein said additional positions comprise further positions, wherein said further positions command said electronics assembly to operate said electronics assembly to operate at least one warning indicator at different intermittent rates.

6. The warning light of claim 5, wherein said intermittent rates comprise 1.0 hertz and 1.5 hertz.

7. The warning light of claim 1, further comprising a diffuser encasing said warning indicators.

8. The warning light of claim 1, wherein said power source comprises at least one battery.

9. The warning light of claim 1, wherein said power source comprises at least one coin battery.

10. The warning light of claim 1, wherein said power source comprises at least one solar cell.

* * * * *